US007241726B2

(12) United States Patent
Song et al.

(10) Patent No.: US 7,241,726 B2
(45) Date of Patent: Jul. 10, 2007

(54) COMPLETE-CYCLE METHODS FOR PROTECTING GLASSWARE FROM SURFACE CORROSION IN AUTOMATIC DISHWASHING APPLIANCES

(75) Inventors: Brian Xiaoqing Song, Mason, OH (US); Paul Joseph Drzewiecki, Maineville, OH (US); Patricia Sara Berger, Cincinnati, OH (US); James Robert Schwartz, West Chester, OH (US); Robert William Corkery, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 112 days.

(21) Appl. No.: 10/963,168

(22) Filed: Oct. 12, 2004

(65) Prior Publication Data

US 2006/0030506 A1 Feb. 9, 2006

Related U.S. Application Data

(60) Provisional application No. 60/511,768, filed on Oct. 16, 2003.

(51) Int. Cl.
*C11D 7/10* (2006.01)

(52) U.S. Cl. ..... 510/220; 510/230; 510/223; 510/227; 510/258; 510/311; 510/253; 510/376; 510/398; 510/401; 510/434; 510/514; 510/521; 134/25.2

(58) Field of Classification Search ..... 510/220, 510/230, 223, 227, 258, 311, 253, 376, 398, 510/401, 434, 514, 521; 134/25.2
See application file for complete search history.

(56) References Cited

U.S. PATENT DOCUMENTS

| | | | | |
|---|---|---|---|---|
| 4,416,794 | A * | 11/1983 | Barrat et al. | 510/514 |
| 4,443,270 | A * | 4/1984 | Biard et al. | 134/25.2 |
| 4,908,148 | A * | 3/1990 | Caravajal et al. | 510/514 |
| 4,917,812 | A * | 4/1990 | Cilley | 510/227 |
| 5,703,030 | A * | 12/1997 | Perkins et al. | 510/311 |
| 6,407,055 | B1 | 6/2002 | Bauer et al. | |
| 6,622,736 | B1 * | 9/2003 | Hahn | 134/25.2 |
| 2004/0121926 | A1 * | 6/2004 | Waits et al. | 510/221 |
| 2004/0180807 | A1 * | 9/2004 | Song et al. | 510/521 |
| 2005/0020464 | A1 * | 1/2005 | Smith et al. | 510/220 |

FOREIGN PATENT DOCUMENTS

| | | | |
|---|---|---|---|
| DE | 101 53 5555 | A1 | 5/2003 |
| EP | 0 561 452 | A1 | 9/1993 |
| WO | WO 01/64823 | | 9/2001 |
| WO | WO 03/104370 | A1 | 12/2003 |

OTHER PUBLICATIONS

International Search Report, PCT/US2004/034553, 4 pages.

* cited by examiner

*Primary Examiner*—Charles Boyer
(74) *Attorney, Agent, or Firm*—Kevin L. Waugh; Laura R. Grunzinger

(57) ABSTRACT

Complete-cycle methods are provided for protecting glassware from corrosion in automatic dishwashing appliances using a through-the-wash detergent composition, especially detergent compositions comprising zinc-containing materials, in combination with a rinse aid composition, especially rinse aid compositions comprising at least one water-soluble metal salt.

9 Claims, 1 Drawing Sheet

Figure 1:
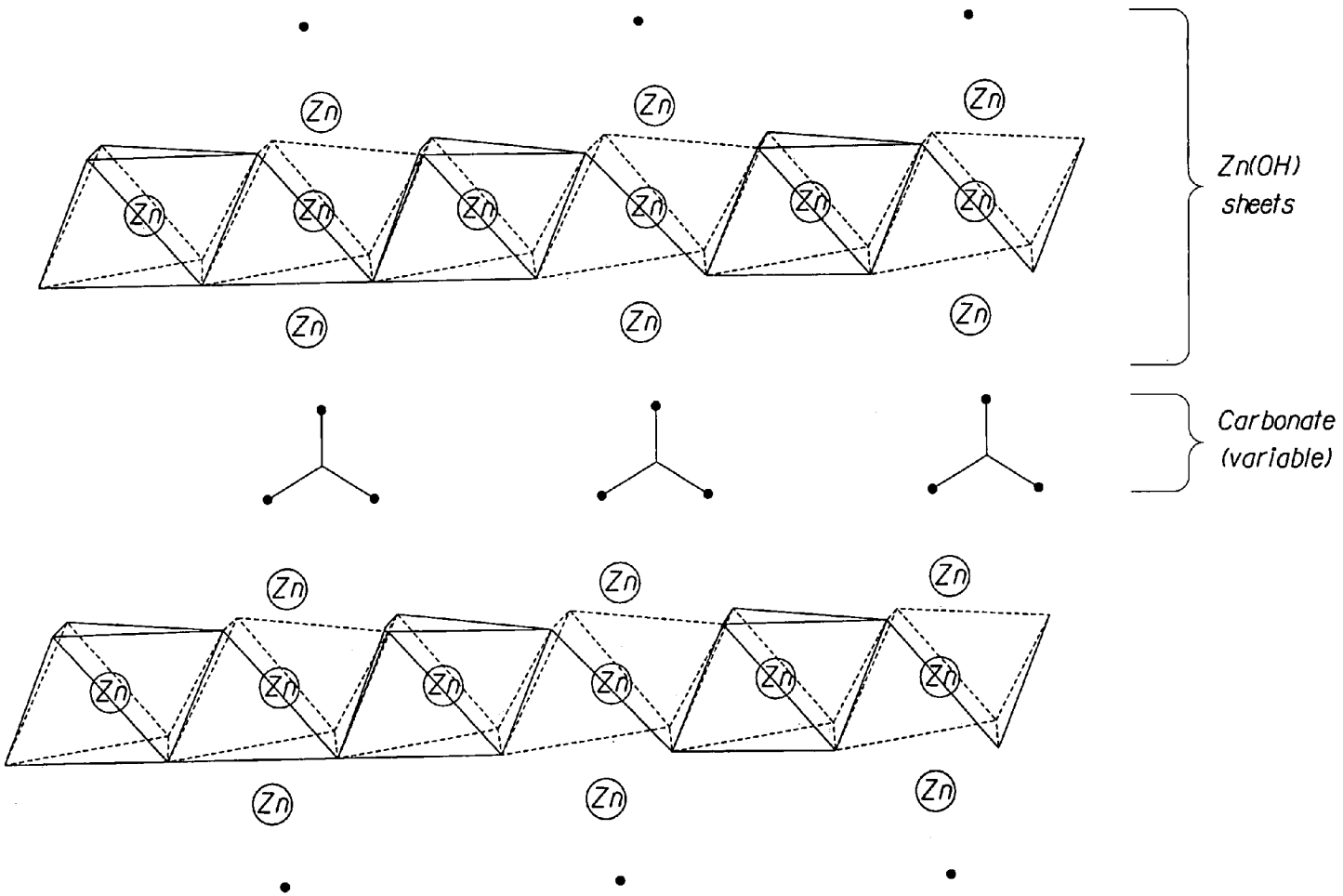

COMPLETE-CYCLE METHODS FOR PROTECTING GLASSWARE FROM SURFACE CORROSION IN AUTOMATIC DISHWASHING APPLIANCES

FIELD OF THE INVENTION

The present invention relates to complete-cycle methods for protecting glassware from corrosion, such as dishes and glasses, in automatic dishwashing appliances using a through the wash detergent composition, especially detergent compositions comprising zinc-containing materials, in combination with a rinse aid composition, especially rinse aid compositions comprising soluble zinc salts.

BACKGROUND

Automatic dishwashing (ADW) detergents constitute a generally recognized distinct class of detergent compositions whose purpose can include to break down and remove food soils; to inhibit foaming; to promote the wetting of wash articles in order to reduce or eliminate visually observable spotting and filming; to remove stains such as might be caused by beverages such as coffee and tea or by vegetable soils such as carotenoid soils; to prevent a buildup of soil films on wash ware surfaces; and to reduce or eliminate tarnishing of flatware without substantially etching or corroding or otherwise damaging the surface of glasses or dishes. The problem of glassware corroding during washing in an automatic dishwashing appliance has long been known. Current opinion is that the problem of corrosion in glassware is the result of two separate phenomena. On one hand, the high pH needed for cleaning causes silica hydrolysis. This dissolved silica/silicate, together with silicates added purposely to prevent china and metal corrosion, deposit on the glassware surface leading to iridescence and clouding. On the other hand, builder removal of chelate metal ions from the glassware surface, and the subsequent metal ion leaching that follows renders a less durable and chemical resistant glass. After several washes in an automatic dishwashing appliance, both phenomena can cause damage to glassware such as cloudiness, scratches, and streaks. This can happen in both the main wash (or through-the-wash) cycles, as well as, in the rinsing/drying cycle.

Most consumers agree that corrosion of glassware from use of detergent compositions in automatic dishwashing (ADW) is one of their most serious unmet needs. ADW detergent compositions containing zinc or magnesium salts of organic acids for improved protection against glass corrosion are known. As these salts are sparingly soluble, they are used for controlled release of reactive zinc species. The use of soluble zinc salts in detergent compositions is difficult to control as precipitates of insoluble zinc salts with other ions in the wash liquor will occur. Yet insoluble zinc salt precipitates may deposit on both the glassware and on the ADW appliance elements itself. Furthermore, some insoluble zinc salts may be too inert to deliver the needed $Zn^{2+}$ ions, as for example zinc oxide (ZnO). Aluminum sulfate salts have also shown promise, but formulatabilty issues remain. For example, flocculation with a polymer thickener and a slight negative on oxygen bleach performance requires an encapsulation approach, which can add formulation costs.

In rinse aid applications, compositions comprising water-soluble metal salts (such as zinc salts of chloride, sulfate or acetate) for use in automatic dishwashing afford some measure of glassware protection. Water-soluble zinc salt may be employed to prevent the corrosion of ceramic surfaces. Solid metal plates of zinc alloys may also be used in combination with a detergent composition to provide corrosion protection to glassware. A water-soluble zinc salt may even be used in conjunction with a low-foaming nonionic surfactant in neutral to high pH. However, the use of this high pH composition in automatic dishwashing can result in unsatisfactory filming and precipitation of insoluble materials. Such precipitant material is very undesirable as it can adhere to internal dishwasher parts, as well as, onto dishware and glassware during the washing cycle. One alternative using soluble zinc and a chelant provides some glassware corrosion protection but has a filming negative (i.e. crystals and films formed on glassware). Yet another alternative is to use insoluble zinc salt to control the release of the $Zn^{2+}$ ions in the rinse to avoid filming. However, there are disadvantages of using insoluble materials in the liquid rinse aid formulations. The product would be cloudy and it requires particular thickeners and stabilizers that may hinder delivery of the product from the rinse aid dispenser to the rinse liquor.

Since glass corrosion occurs in both the wash and rinse/drying cycles, there is a continuing need to develop improved complete-cycle, ADW methods using both a through-the-wash (TTW) detergent composition and a rinse aid composition so that the problem of glassware corrosion is reduced versus using either compositions alone.

SUMMARY OF THE INVENTION

The present invention relates to domestic, institutional, industrial, and/or commercial complete-cycle methods for protecting glassware surfaces from corrosion in an automatic dishwashing appliance using a TTW ADW detergent composition having an effective amount of certain zinc-containing materials, such as, particulate zinc-containing materials (PZCMs) and zinc-containing layered materials (ZCLMs), in combination with a rinse aid composition having an effective amount of at least one metal salt.

In accordance with one aspect, a domestic, institutional, industrial, and/or commercial complete-cycle method of treating glassware surfaces in automatic dishwashing is provided. The method comprises the steps of: (a) providing a through-the-wash detergent composition comprising an effective amount of a particulate zinc-containing material; (b) providing a rinse aid composition comprising an effective amount of at least one metal salt; (c) contacting the glassware surface with the through-the-wash detergent composition; and (d) contacting the glassware surface with the rinse aid composition in the rinse cycle.

In another aspect, domestic, institutional, industrial, and/or commercial complete-cycle method of treating glassware surfaces with a composition of matter in automatic dishwashing is provided. The method comprises the steps of: (a) providing a composition of matter comprising a wash liquor, the wash liquor comprising a through-the-wash detergent composition comprising: (i) an effective amount of a particulate zinc-containing material; (ii) a detergent active; (iii) optionally, one or more of the following: dispersant polymers or carrier medium; and (iv) optionally, an adjunct ingredient; (b) providing a composition of matter comprising a rinse liquor, the rinse liquor comprising a rinse aid composition comprising: (i) an effective amount of at least one water-soluble metal salt; (ii) an acid; (iii) a non-ionic surfactant; (iv) at least one of the following: a dispersant polymer, a perfume, and mixtures thereof; and (v) optionally, at least one component selected from the group consisting of: an acid, a dispersant polymer, a perfume, a hydrotrope, a binder, a carrier medium, an antibacterial active, a dye, and mixtures thereof; (c) contacting the glassware surface with the wash liquor; and (d) contacting the glassware surface with the rinse liquor; wherein the rinse aid composition has a pH of less than about 5 when measured at a 10% concentration in an aqueous solution.

In accordance with another aspect, a treatment system is provided. The treatment system comprises a kit comprising: (a) a package; (b) a TTW ADW detergent composition; (c) a rinse aid composition, and (d) instructions for use.

DRAWING DESCRIPTION

FIG. 1 represents a side view of the structure of a zinc-containing layered material.

DETAILED DESCRIPTION

It has surprisingly been found that glassware surfaces in automatic dishwashing can be protected during at least part of both the wash and rinse cycles using the complete-cycle methods of treating glassware surfaces described herein. Complete-cycle glassware surface corrosion protection combines wash cycle protection and rinse cycle corrosion protection in one treatment method. This treatment method not only provides substantial corrosion protection but also delivers other desirable benefits to the treated glassware surfaces, such as providing anti-filming benefits.

Wash Cycle Corrosion Protection

Glassware in automatic dishwashing can be protected using methods of treating glassware surfaces by contacting glassware with TTW ADW detergent compositions containing certain zinc-containing materials, such as, particulate zinc-containing materials (PZCMs) and zinc-containing layered materials (ZCLMs). This is especially true in soft water conditions where chelating agents and builders can damage glassware by chelating metal ions in the glass structure itself. Thus, even in such harsh TTW environments, glass damage from surface corrosion can be reduced with the use of ZCLMs in ADW detergent compositions without the negative effects associated with the use of metal salts, such as: (a) increased cost of manufacture; (b) the need for higher salt levels in the formula due to poor solubility of the insoluble material; (c) the thinning of gel detergent compositions by interaction of the metal ions, for example $Al^{3+}$ ions and $Zn^{2+}$ ions, with the thickener material; or (d) a reduction in the cleaning performance for tea, stains by interfering with the bleach during the entire wash cycle. It has also surprisingly been found that the glass care benefit of the ZCLM is significantly enhanced when the ZCLM is dispersed prior to adding to or during the process of manufacturing the TTW ADW detergent composition. Achieving good dispersion of the ZCLM particles in the TTW ADW detergent composition significantly reduces agglomeration of the ZCLM particles in the wash liquor.

In the methods described herein, any suitable TTW ADW detergent composition may be used, alone or in combination with a composition of matter (such as the wash liquor), and/or as part of a treatment system comprising a kit having an effective amount of certain zinc-containing materials, such as, PZCMs and ZCLMs. By "effective amount" herein is meant an amount that is sufficient, under the comparative test conditions described herein, to reduce glassware surface corrosion damage on treated glassware through-the-wash.

Particulate Zinc-containing Materials (PZCMs)

Particulate zinc-containing materials (PZCMs) remain mostly insoluble within formulated compositions. Examples of PZCMs useful in certain non-limiting embodiments may include the following:

Inorganic Materials: zinc aluminate, zinc carbonate, zinc oxide and materials containing zinc oxide (i.e., calamine), zinc phosphates (i.e., orthophosphate and pyrophosphate), zinc selenide, zinc sulfide, zinc silicates (i.e., ortho- and meta-zinc silicates), zinc silicofluoride, zinc borate, zinc hydroxide and hydroxy sulfate, zinc-containing layered materials, and combinations thereof.

Natural Zinc-containing Materials/Ores and Minerals: sphalerite (zinc blende), wurtzite, smithsonite, franklinite, zincite, willemite, troostite, hemimorphite, and combinations thereof.

Organic Salts: zinc fatty acid salts (i.e., caproate, laurate, oleate, stearate, etc.), zinc salts of alkyl sulfonic acids, zinc naphthenate, zinc tartrate, zinc tannate, zinc phytate, zinc monoglycerolate, zinc allantoinate, zinc urate, zinc amino acid salts (i.e., methionate, phenylalinate, tryptophanate, cysteinate, etc), and combinations thereof.

Polymeric Salts: zinc polycarboxylates (i.e., polyacrylate), zinc polysulfate, and combinations thereof.

Physically Adsorbed Forms: zinc-loaded ion exchange resins, zinc adsorbed on particle surfaces, composite particles in which zinc salts are incorporated (i.e., as core/shell or aggregate morphologies), and combinations thereof.

Zinc Salts: zinc oxalate, zinc tannate, zinc tartrate, zinc citrate, zinc oxide, zinc carbonate, zinc hydroxide, zinc oleate, zinc phosphate, zinc silicate, zinc stearate, zinc sulfide, zinc undecylate, and the like, and combinations thereof.

Commercially available sources of zinc oxide include Z-Cote and Z-Cote HPI (BASF), and USP I and USP II (Zinc Corporation of America).

Physical Properties of PZCM Particles

In the methods described herein, many benefits of using PZCMs in TTW ADW detergent compositions require that the $Zn^{2+}$ ion be chemically available without being soluble. This is termed "zinc lability". Certain physical properties of the PZCM have the potential to impact zinc lability. We have developed more effective TTW ADW detergent composition formulations based on optimizing PZCM zinc lability.

Some PZCM physical properties that can impact zinc lability may include, but are not limited to: crystallinity, surface area, and morphology of the particles, and combinations thereof. Other PZCM physical properties that may also impact zinc lability of PZCMs include, but are not limited to: bulk density, surface charge, refractive index, purity level, and combinations thereof.

Crystallinity

A PZCM having a less crystalline structure may result in a higher relative zinc lability. One can measure crystal imperfections or crystalline integrity of a particle by full width half maximum (FWHM) of reflections of an x-ray diffraction (XRD) pattern. Not wishing to be bound by theory, it is postulated that the larger the FWHM value, the lower the level of crystallinity in a PZCM. The zinc lability appears to increase as the crystallinity decreases. Any suitable PZCM crystallinity may be used. For example, suitable crystallinity values may range from about 0.01 to 1.00, or from about 0.1 to about 1.00, or form about 0.1 to about 0.90, or from about 0.20 to about 0.90, and alternatively, from about 0.40 to about 0.86 FWHM units at a 200 (~2θ, 6.9 Å) reflection peak.

Particle Size

The PZCM particles in the TTW ADW detergent composition may have any suitable average particle size. In certain non-limiting embodiment, it is has been found that a smaller particle size is directly proportional to an increase in relative zinc lability (%). Suitable average particle sizes include, but not limited to: a range of from about 10 nm to about 100 microns, or from about 10 nm to about 50 microns, or from about 10 nm to about 30 microns, or from about 10 nm to about 20 microns, or from about 10 nm to about 10 microns, and alternatively, from about 100 nm to about 10 microns. In another non-limiting embodiment, the PZCM may have an average particle size of less than about 15 microns, or less than about 10 microns, and alternatively less than about 5 microns.

Particle Size Distribution

Any suitable PZCM particle size distribution may be used. Suitable PZCM particle size distributions include, but are not limited to: a range from about 1 nm to about 150 microns, or from about 1 nm to about 100 microns, or from about 1 nm to about 50 microns, or from about 1 nm to about 30 microns, or from about 1 nm to about 20 microns, or from about 1 nm to about 10 microns, or from about 1 nm to about 1 micron, or from about 1 nm to about 500 nm, or from about 1 nm to about 100 nm, or from about 1 nm to about 50 nm, or from about 1 nm to about 30 nm, or from about 1 nm to about 20 nm, and alternatively, from about 1 nm or less, to about 10 nm.

Zinc-containing Layered Materials (ZCLMs)

As already defined above, ZCLMs are a subclass of PZCMs. Layered structures are those with crystal growth primarily occurring in two dimensions. It is conventional to describe layer structures as not only those in which all the atoms are incorporated in well-defined layers, but also those in which there are ions or molecules between the layers, called gallery ions (A. F. Wells "Structural Inorganic Chemistry" Clarendon Press, 1975). For example, ZCLMs may have $Zn^{2+}$ ions incorporated in the layers and/or as more labile components of the gallery ions.

Many ZCLMs occur naturally as minerals. Common examples include hydrozincite (zinc carbonate hydroxide), basic zinc carbonate, aurichalcite (zinc copper carbonate hydroxide), rosasite (copper zinc carbonate hydroxide) and many related minerals that are zinc-containing. Natural ZCLMs can also occur wherein anionic layer species such as clay-type minerals (e.g., phyllosilicates) contain ion-exchanged zinc gallery ions. Other suitable ZCLMs include the following: zinc hydroxide acetate, zinc hydroxide chloride, zinc hydroxide lauryl sulfate, zinc hydroxide nitrate, zinc hydroxide sulfate, hydroxy double salts, and mixtures thereof. Natural ZCLMs can also be obtained synthetically or formed in situ in a composition or during a production process.

Hydroxy double salts can be represented by the general formula:

$$[M^{2+}{}_{1-x}M^{2+}{}_{1+x}(OH)_{3(1-y)}]^{+}A^{n-}{}_{(1=3y)/n}.nH_2O$$

where the two metal ions may be different; if they are the same and represented by zinc, the formula simplifies to $[Zn_{1+x}(OH)_2]^{2x+}2xA^{-}.nH_2O$ (see Morioka, H., Tagaya, H., Karasu, M, Kadokawa, J, Chiba, K *Inorg. Chem.* 1999, 38, 4211-6). This latter formula represents (where x=0.4) common materials such as zinc hydroxychloride and zinc hydroxynitrate. These are related to hydrozincite as well, when a divalent anion replaces the monovalent anion.

Commercially available sources of zinc carbonate include zinc carbonate basic (Cater Chemicals: Bensenville, Ill., USA), zinc carbonate (Shepherd Chemicals: Norwood, Ohio, USA), zinc carbonate (CPS Union Corp.: New York, N.Y., USA), zinc carbonate (Elementis Pigments: Durham, UK), and zinc carbonate AC (Bruggemann Chemical: Newtown Square, Pa., USA).

The abovementioned types of ZCLMs represent relatively common examples of the general category and are not intended to be limiting as to the broader scope of materials that fit this definition.

Any suitable ZCLM in any suitable amount may be used in the methods described herein. Suitable amounts of a ZCLM include, but are not limited to: a range: from about 0.001% to about 20%, or from about 0.001% to about 10%, or from about 0.01% to about 7%, and alternatively, from about 0.1% to about 5% by weight of the composition.

ZCLM Glass Network Strengthening Mechanism

It is well known that silica glass is a continuous three-dimensional (3D) network of corner-shared Si—O tetrahedra-lacking symmetry and periodicity (see W. H. Zachariasen, J. Am. Chem. Soc. 54, 3841, 1932). $Si^{4+}$ ions are network forming ions. At the vertex of each tetrahedron, and shared between two tetrahedra, is an oxygen atom known as a bridging oxygen.

Mechanical glass surface properties, such as chemical resistance, thermal stability, and durability, may depend on the glassware surface structure itself. Without wishing to bound by theory, it is believed that when some network forming positions are occupied by zinc compounds or $Zn^{2+}$ ions, the mechanical properties of the glassware surface structure improve (see G. Calas et al. C. R. Chimie 5 2002, 831-843).

FIG. 1 depicts a zinc-containing layered structure with crystal growth primarily occurring in two dimensions. A $Zn^{2+}$ ions are incorporated in the layers and/or as more labile components of the gallery ions. For example, ZCLMs, such as synthetic zinc carbonate hydroxide (ZCH) or natural-occurring hydrozincite (HZ), may have the formula:

$$3Zn(OH)_2.2ZnCO_3 \text{ or } Zn_5(OH)_6(CO_3)_2,$$

and consist of $Zn^2$+ ions forming brucite type hydroxide layers with some octahedral vacancies as shown in FIG. 1. Some of the $Zn^2$+ ions are positioned just above and below the vacant sites outside the hydroxide layers in tetrahedral (Td) coordination. Interlayer anions are weakly bound to the Td $Zn^2$+ ions completing the Td coordination. In the wash liquor, an ADW detergent composition with labile Td $Zn^2$+ ions is stable at the typical alkaline pH.

When a ZCLM is present in the wash water, the cationic charge on the brucite type hydroxide layers is the driving force for interaction with the negatively charged glass surface. This leads to efficient deposition of zinc compounds or $Zn^2$+ ions on the glass surface such that very low level of ZCLMs are needed to deliver a benefit. Once the brucite type hydroxide layers are placed in contact with the glass, zinc compounds or $Zn^2$+ ions can readily deposit on the glass and fill in the vacancies created by metal ion leaching and silica hydrolysis commonly occurring with ADW products. Thus, new zinc compounds or Zn2+ ions, introduced as glass network formers, strengthen the glass and prevent glass corrosion during further washes.

TTW ADW Detergent Compositions and Compositions of Matter

The methods described herein provide at least some glassware surface corrosion protection to glassware surfaces when treated with the TTW ADW detergent composition during at least some portion of the wash cycle.

In one non-limiting embodiment, a TTW ADW detergent composition comprises an effective amount of a ZCLM, such that when the ZCLM is placed in contact with the glassware surface, an amount of zinc compounds or $Zn^2$+ ions is deposited on and/or within the imperfections or vacancies in the glassware surface. For example, the treated glassware surface may have zinc compounds or $Zn^2$+ ions present from about 1 nm up to about 1 micron, or from about 1 nm to about 500 nm, or from about 1 nm to about 100 nm, or from about 1 nm to about 50 nm, or from about 1 nm to about 20 nm, and alternatively, from about 1 nm to about 10 nm above and/or below the treated glassware surface.

In another non-limiting embodiment, a composition of matter comprises a wash liquor, which comprises a TTW ADW detergent composition comprising an effective amount of a ZCLM, in an automatic dishwashing appliance during at least a part of the wash cycle, wherein from about 0.0001 ppm to about 100 ppm, or from about 0.001 ppm to about 50 ppm, or from about 0.01 ppm to about 30 ppm, and alternatively, from about 0.1 ppm to about 10 ppm of a ZCLM may be present in the wash liquor.

Any suitable pH in an aqueous TTW ADW detergent composition containing a ZCLM may be used in the methods described herein. In certain embodiments, a suitable pH may fall anywhere within the range of from about 6.5 to about 14. For example, certain embodiments of the TTW ADW detergent composition have a pH of greater than or equal to about 6.5, or greater than or equal to about 7, or greater than or equal to about 9, and alternatively, greater than or equal to about 10.0.

Rinse Cycle Corrosion Protection

Acidic ADW environments are also typically hard on glassware surfaces. Glassware surface corrosion is a complex process that occurs quickly in acidic environments. Generally, however, rinse aid compositions having a lower pH will exhibit higher initial glassware surface corrosion rates. It has been surprisingly found that at a pH below about 5, and without the use of at least some chelating agent, a rinse aid composition comprising a water-soluble metal salt (in conjunction with specific components, such as acid, non-ionic surfactants, dispersant polymers, perfumes, and/or adjunct ingredients) can provide improved glassware surface corrosion protection while delivering a better smelling product having an improved glassware anti-filming benefit without the unwanted precipitation of insoluble materials on glassware.

Any suitable method of treating glassware in an automatic dishwashing appliance may be used. Suitable methods comprise the step of contacting a glassware surface with any suitable rinse aid composition during at least a part of rinse cycle, alone or in combination with a composition of matter, and/or treatment system having an effective amount of a metal salt, metal oxide, zinc salt, water-soluble zinc salt, and mixtures thereof may be used. By "effective amount" herein is meant an amount that is sufficient, under whatever comparative test conditions are employed, to reduce glassware surface corrosion damage on treated glassware through the rinse.

By formulating the water-soluble metal salt with an acid, either organic or inorganic, unwanted precipitation on glassware surfaces is reduced. In liquid rinse aid compositions, the acid enables the water-soluble metal salt to fully dissolve in the rinse aid composition and thereby reduces the chances of a precipitate formation on glassware surfaces during the rinse cycle.

In the case of a liquid rinse aid composition, adding an acid to the rinse aid composition enables the water-soluble metal salt to at least partially dissolve, and alternatively to fully dissolve, in the composition. The acid also helps to at least partially reduce the precipitation on hard surfaces during the rinse cycle. The acid may be also needed to stabilize the liquid rinse aid composition against precipitation in the product prior to use. In the case of a solid rinse aid composition, adding an acid to the rinse aid composition enables the water-soluble metal salt, once released, to at least partially dissolve, and alternatively to fully dissolve, quickly in the wash and/or rinse liquor of an automatic dishwashing appliance so as to prevent insoluble material from forming and/or from depositing onto hard surfaces, such as on flatware, glasses, dishes and/or components inside the automatic dishwashing appliance itself.

When an acid is added to a solid rinse aid composition, the water-soluble metal salt dissolves quickly once delivered to the rinse liquor. The addition of a water-soluble metal salt in the presence of an acid also significantly improves anti-filming performance on glassware. Surprisingly, the addition of a dispersant polymer to this metal salt/acid mixture further improves glassware anti-filming performance. The addition of a perfume to the rinse aid composition improves the odor profile of the consumer rinse aid product before, as well as, during the operation of the automatic dishwasher.

The solid water-soluble metal salt may be in the form of a powder, crystal, core particle, aggregate of core particles, prill, agglomerate, and mixtures thereof. These solid forms may be nonfriable for handling purposes during processing and when used by consumers. The water-soluble metal salt can be used directly as the raw material in the rinse aid composition or it can be provided as an additive compound, which may be added along with other components to form the rinse aid composition.

Water-soluble Metal Salt

The methods described herein may comprise any suitable water-soluble metal salt in any suitable amount or form. The rinse aid composition may deliver any suitable amount of the water-soluble metal salt to at least some of the rinse liquor during at least part of the rinse cycle. For example, the rinse aid composition may deliver to the rinse liquor during at least a part of the rinse cycle from about 0.01 mM to about 10 mM, or from about 0.02 mM to about 5 mM, or from about 0.05 mM to about 1 mM, and alternatively from about 0.05 mM to about 0.5 mM of the water-soluble metal salt. Alternatively, the rinse aid composition may deliver to the rinse liquor during at least a part of the rinse cycle from about 0.1% to about 20%, or from about 0.2% to about 15%, or from about 0.5% to about 10%, and alternatively from about 1% to about 5% by weight of the composition. Another non-limiting embodiment of the method is directed to contacting a glassware surface with a composition of matter comprising rinse liquor, comprising a rinse aid composition comprising an effective amount of a water-soluble metal salt, in an automatic dishwashing appliance during at least a part of the rinse cycle, wherein from about 0.0001 ppm to about 100 ppm, or from about 0.001 ppm to about 50 ppm, or from about 0.01 ppm to about 30 ppm, and alternatively, from about 0.1 ppm to about 20 ppm of the water-soluble metal salt may be present in the rinse liquor.

The water-soluble metal salt may, for example, be present in the rinse aid composition in an amount from about 0.01% to about 70%, or from about 0.1% to about 50%, or from about 0.5% to about 30%, and alternatively from about 1% to about 10% by weight of the composition. In the methods described herein, the rinse aid composition may deliver from about 0.1% to about 20% by weight of the composition of a metal ion selected from the group consisting of $Zn^{2+}$ ions, $Al^{3+}$ ions, $Mg^{2+}$ ions, $Ca^{2+}$ ions, any other suitable metal ions, and mixtures thereof, to at least some of the rinse liquor during at least part of the rinse cycle of an automatic dishwashing appliance. One non-limiting embodiment of the method is directed to contacting a glassware surface with a rinse aid composition comprising an effective amount of a water-soluble salt selected from the group consisting of aluminum, zinc, magnesium, calcium, lanthanum, tin, gallium, strontium, titanium, and mixtures thereof.

Zinc Salt

In the methods described herein, any suitable water-soluble salt of zinc in any suitable amount may be used in the rinse aid composition. Suitable water-soluble zinc salts include, but are not limited to: zinc acetate, zinc benzoate, zinc borate, zinc bromide, zinc chloride, zinc formate, zinc gluconate, zinc lactate, zinc laurate, zinc malate, zinc nitrate, zinc perborate, zinc sulfate, zinc sulfamate, zinc tartrate, and mixtures thereof.

Water-soluble zinc salt can also be formed in-situ by reacting zinc oxide and an acid in rinse aid formulations. Any acid, organic or inorganic, that does not result in precipitation of the zinc salt in the composition after mixing can also be used. A rinse aid composition may comprise a water-soluble zinc salt, which is prepared in-situ by mixing zinc oxide with an acid. For example, in the formulation of a liquid rinse aid composition, the components are mixed until all powder is dissolved to give a clear solution. After the in-situ neutralization process, other ingredients can be added into the liquid mixture to formulate a liquid rinse aid composition. In another example, a binder or a solid surfactant (e.g. solid at 25° C.) may be used to formulate the solid rinse aid composition.

Aluminum Salt

In the methods described herein, any suitable water-soluble salt of aluminum in any suitable amount may be used in the rinse aid compositions. Suitable water-soluble aluminum salts include, but are not limited to: aluminum acetate, aluminum ammonium sulfate, aluminum chlorate, aluminum chloride, aluminum chlorohydrate, aluminum diformate, aluminum formoacetate, aluminum monostearate, aluminum lactate, aluminum nitrate, aluminum sodium sulfate, aluminum sulfate, aluminum stearate, aluminum tartrate, aluminum triformate, and mixtures thereof.

Magnesium Salt

In the methods described herein, any suitable water-soluble salt of magnesium in any suitable amount may be used in the rinse aid composition. Water-soluble magnesium salts include, but are not limited to: magnesium acetate, magnesium acetylacetonate, magnesium ammonium phosphate, magnesium benzoate, magnesium biophosphate, magnesium borate, magnesium borocitrate, magnesium bromate, magnesium bromide, magnesium calcium chloride, magnesium chlorate, magnesium chloride, magnesium citrate, magnesium dichromate, magnesium fluosilicate, magnesium formate, magnesium gluconate, magnesium glycerophosphate, magnesium lauryl sulfate, magnesium nitrate, magnesium perchlorate, magnesium permanganate, magnesium salicylate, magnesium stannate, magnesium stannide, magnesium sulfate, and mixtures thereof.

Calcium Salt

In the methods described herein, any suitable water-soluble salt of calcium in any suitable amount may be used in the rinse aid composition. Water-soluble calcium salts include, but are not limited to: calcium acetate, calcium acetylsalicylate, calcium acrylate, calcium ascorbate, calcium borate, calcium bromate, calcium bromide, calcium chlorate, calcium chloride, calcium cyclamate, calcium dehydroacetate, calcium dichromate, calcium disodium edetate, calcium ethylhexoate, calcium formate, calcium gluconate, calcium iodate, calcium nitrite, calcium pantothenate, calcium perborate, calcium perchlorate, calcium permanganate, calcium propionate, calcium tartate, and calcium thiocynnate, and mixtures thereof.

Other Water-soluble Metal Salts

In the methods described herein, any other suitable water-soluble metal salt selected from the group consisting of lanthanum, tin, gallium, strontium, titanium, and combinations thereof, may also be used in the rinse aid compositions and/or delivered to the rinse liquor in an automatic dishwashing appliance in the same manner and amount as disclosed above.

Complete-cycle Components

Any suitable detergent active in any suitable amount of form may be used. Suitable detergent actives may be used in the through-the-wash detergent composition and/or the rinse aid composition. Suitable detergent actives include, but are not limited to: surfactants, surfactant systems, acids, suds suppressors, builders, builder systems, enzymes, bleach, bleaching systems, dispersant polymers, carrier mediums, hydrotropes, perfumes, and mixtures thereof.

Surfactants

Any suitable surfactant in any suitable amount or form may be used. The methods described herein may use one or more suitable surfactants, optionally in a surfactant system, in any suitable amount or form. Suitable surfactants may include, but are not limited to: anionic surfactants, cationic surfactants, nonionic surfactants, amphoteric surfactants, ampholytic surfactants, zwitterionic surfactants, and mixtures thereof. For example, a mixed surfactant system may comprise one or more different types of the above-described surfactants.

Suitable anionic surfactants for use herein include, but are not limited to: alkyl sulfates, alkyl ether sulfates, alkyl benzene sulfonates, alkyl glyceryl sulfonates, alkyl and alkenyl sulphonates, alkyl ethoxy carboxylates, N-acyl sarcosinates, N-acyl taurates and alkyl succinates and sulfosuccinates, wherein the alkyl, alkenyl or acyl moiety is $C_5$-$C_{20}$, or $C_{10}$-$C_{18}$ linear or branched. Suitable cationic surfactants include, but are not limited to: chlorine esters and mono $C_6$-$C_{16}$ N-alkyl or alkenyl ammonium surfactants, wherein the remaining N positions are substituted by methyl, hydroxyethyl or hydroxypropyl groups. Suitable nonionic surfactants include, but are not limited to: low and high cloud point surfactants, and mixtures thereof. Suitable amphoteric surfactants include, but are not limited to: the $C_{12}$-$C_{20}$ alkyl amine oxides (for example, lauryldimethyl amine oxide and hexadecyl dimethyl amine oxide), and alkyl amphocarboxylic surfactants, such as MIRANOL® C2M. Suitable zwitterionic surfactants include, but are not limited to: betaines and sultaines; and mixtures thereof. Surfactants suitable for use are disclosed, for example, in U.S. Pat. Nos. 3,929,678; 4,223,163; 4,228,042; 4,239,660; 4,259,217; 4,260,529; and 6,326,341; EP Pat. No. 0414 549, EP Pat. No. 0,200,263, PCT Pub. No. WO 93/08876 and PCT Pub. No. WO 93/08874.

Suitable nonionic surfactants also include, but are not limited to low-foaming nonionic (LFNI) surfactants. A LFNI surfactant is most typically used in a product due to its ability to improve water-sheeting action (especially from glassware). They also may encompass non-silicone, phosphate or nonphosphate polymeric materials which are known to defoam food soils encountered in automatic dishwashing. The LFNI surfactant may have a relatively low cloud point and a high hydrophilic-lipophilic balance (HLB). Cloud points of 1% solutions in water are typically below about 32° C. and alternatively lower, e.g., 0° C., for optimum control of sudsing throughout a full range of water temperatures. If desired, a biodegradable LFNI surfactant having the above properties may be used.

A LFNI surfactant may include, but is not limited to: alkoxylated surfactants, especially ethoxylates derived from primary alcohols, and blends thereof with more sophisticated surfactants, such as the polyoxypropylene/polyoxyethylene/polyoxypropylene reverse block polymers. Suitable block polyoxyethylene-polyoxypropylene polymeric compounds that meet the requirements may include those based on ethylene glycol, propylene glycol, glycerol, trimethylolpropane and ethylenediamine, and mixtures thereof. Polymeric compounds made from a sequential ethoxylation and propoxylation of initiator compounds with a single reactive hydrogen atom, such as $C_{12-18}$ aliphatic alcohols, do not generally provide satisfactory suds control. However, certain of the block polymer surfactant compounds designated as PLURONIC® and TETRONIC® by the BASF-Wyandotte Corp., Wyandotte, Mich., are suitable in suds control.

The LFNI surfactant can optionally include a propylene oxide in an amount up to about 15% by weight. Other LFNI surfactants can be prepared by the processes described in U.S. Pat. No. 4,223,163. The LFNI surfactant may also be derived from a straight chain fatty alcohol containing from about 16 to about 20 carbon atoms ($C_{16}$-$C_{20}$ alcohol), alternatively a $C_{18}$ alcohol, condensed with an average of from about 6 to about 15 moles, or from about 7 to about 12 moles, and alternatively, from about 7 to about 9 moles of ethylene oxide per mole of alcohol. The ethoxylated nonionic surfactant so derived may have a narrow ethoxylate distribution relative to the average.

In certain embodiments, a LFNI surfactant having a cloud point below 30° C. may be present in an amount from about 0.01% to about 60%, or from about 0.5% to about 10% by weight, and alternatively, from about 1% to about 5% by weight of the composition.

Acid

Any suitable organic and/or inorganic acid in any suitable amount or form may be used. Suitable acids include, but are not limited to: acetic acid, aspartic acid, benzoic acid, boric acid, bromic acid, citric acid, formic acid, gluconic acid, glutamic acid, hydrochloric acid, lactic acid, malic acid, nitric acid, sulfamic acid, sulfuric acid, tartaric acid, and mixtures thereof.

Acids used for in-situ preparation of water-soluble metal salts must be non-precipitating acids. Certain acids will not result in precipitation of the water-soluble metal salt in the rinse aid composition and/or product itself or in rinse liquor of the automatic dishwashing appliance during the rinse cycle. For example, nitric acid, hydrochloric acid, and mixtures thereof, are typically non-precipitation acids. Conversely, other acids, like phosphoric acid, citric acid, and mixtures thereof, are precipitating acids, which may result in precipitation of an insoluble metal salt in the rinse aid composition and/or product itself. These precipitating acids cannot be used in the in-situ water-soluble metal salt preparation process itself. However, a low level of a precipitating acid may be added after the completion of the in-situ water-soluble metal salt preparation process.

The amount of acid needed in the in-situ water-soluble metal salt preparation process may, for example, be determined stoichimetrically using the formula:

$$2H_xA+XZnO \rightarrow XZnA_{2/x}+XH_2O$$

wherein A is an organic and/or an inorganic acid, and x is an integer that varies from 1 to 2.

Suitable acids are typically present in an rinse aid compositions in the range from about 0.01% to about 25%, or from about 0.5% to about 20%, and alternatively from about 1% to about 10%, by weight of the composition. The acid used in the in-situ water-soluble metal salt preparation process may be selected from the group consisting of acetic acid, formic acid, gluconic acid, glutamic acid, hydrochloric acid, malic acid, nitric acid, sulfuric acid, and mixtures thereof, by weight of the mixture may be used. One non-limiting embodiment of the method is directed to contacting a glassware surface with a rinse aid composition comprising an acid formed in-situ in an amount from about 0.01% to about 25% by weight of the total composition.

Suds Suppressor

Any suitable suds suppressor in any suitable amount or form may be used. Suds suppressors suitable for use may be low foaming and include low cloud point nonionic surfactants (as discussed above) and mixtures of higher foaming surfactants with low cloud point nonionic surfactants which act as suds suppressors therein (see PCT Pub. No. WO 93/08876; EP Pat. No. 0705324, U.S. Pat. Nos. 6,593,287, 6,326,341 and 5,576,281. In certain embodiments, one or more suds suppressors may be present in an amount from about 0% to about 30% by weight, or about 0.2% to about 30% by weight, or from about 0.5% to about 10%, and alternatively, from about 1% to about 5% by weight of composition.

Builder System

Any suitable builder system comprising any suitable builder in any suitable amount or form may be used. Any conventional builder is suitable for use herein. For example, suitable builders include, but are not limited to: citrate, phosphate (such as sodium tripolyphosphate, potassium tripolyphosphate, mixed sodium and potassium tripolyphosphate, sodium or potassium or mixed sodium and potassium pyrophosphate), aluminosilicate materials, silicates, polycarboxylates and fatty acids, materials such as ethylenediamine tetraacetate, metal ion sequestrants such as aminopolyphosphonates, ethylenediamine tetramethylene phosphonic acid and diethylene triamine pentamethylenephosphonic acid.

Examples of other suitable builders are disclosed in the following patents and publications: U.S. Pat. Nos. 3,128,287; 3,159,581; 3,213,030; 3,308,067; 3,400,148; 3,422,021; 3,422,137; 3,635,830; 3,835,163; 3,923,679; 3,985,669; 4,102,903; 4,120,874; 4,144,226; 4,158,635; 4,566,984; 4,605,509; 4,663,071; and 4,663,071; German Patent Application No. 2,321,001 published on Nov. 15, 1973; European Pat. No. 0,200,263; Kirk Othmer, 3rd Edition, Vol. 17, pp. 426-472 and in "Advanced Inorganic Chemistry" by Cotton and Wilkinson, pp. 394-400 (John Wiley and Sons, Inc.; 1972).

Enzyme

Any suitable enzyme and/or enzyme stabilizing system in any suitable amount or form may be used. Enzymes suitable for use include, but are not limited to: proteases, amylases, lipases, cellulases, peroxidases, and mixtures thereof. Amylases and/or proteases are commercially available with improved bleach compatibility. In practical terms, the TTW ADW detergent composition may comprise an amount up to about 5 mg, more typically about 0.01 mg to about 3 mg by weight, of active enzyme per gram of the composition. Protease enzymes are usually present in such commercial preparations at levels sufficient to provide from 0.005 to 0.1 Anson units (AU) of activity per gram of composition, or 0.01%-1% by weight of a commercial enzyme preparation.

For automatic dishwashing purposes, it may be desirable to increase the active enzyme content in order to reduce the total amount of non-catalytically active materials delivered and thereby improve anti-spoting/anti-filming results. In certain embodiments, enzyme-containing TTW ADW detergent compositions, especially liquid, liquid gel, and gel compositions, may comprise from about 0.0001% to about 10%, or from about 0.005% to about 8%, or from about 0.01% to about 6%, by weight of an enzyme stabilizing system. The enzyme stabilizing system can be any stabilizing system that is compatible with the detersive enzyme. Such stabilizing systems can include, but are not limited to: calcium ions, boric acid, propylene glycol, short chain carboxylic acid, boronic acid, and mixtures thereof.

Bleaching System

Any suitable bleaching agent or system in any suitable amount or form may be used. Bleaching agents suitable for use include, but are not limited to: chlorine and oxygen bleaches. In certain embodiments, a bleaching agent or system may be present in an amount from about 0% to about 30% by weight, or about 1% to about 15% by weight, or from about 1% to about 10% by weight, and alternatively from about 2% to about 6% by weight of composition.

Suitable bleaching agents include, but are not limited to: inorganic chlorine (such as chlorinated trisodium phosphate), organic chlorine bleaches (such as chlorocyanurates, water-soluble dichlorocyanurates, sodium or potassium dichloroisocyanurate dihydrate, sodium hypochlorite and other alkali metal hypochlorites); inorganic perhydrate salts (such as sodium perborate mono- and tetrahydrates and sodium percarbonate, which may be optionally coated to provide controlled rate of release as disclosed in UK Pat. No. GB 1466799 on sulfate/carbonate coatings), preformed organic peroxyacids, and mixtures thereof.

Peroxygen bleaching compounds can be any peroxide source comprising sodium perborate monohydrate, sodium perborate tetrahydrate, sodium pyrophosphate peroxyhydrate, urea peroxyhydrate, sodium percarbonate, sodium peroxide, and mixtures thereof. In other non-limiting embodiments, peroxygen-bleaching compounds may comprise sodium perborate monohydrate, sodium perborate tetrahydrate, sodium percarbonate, and mixtures thereof.

The bleaching system may also comprise transition metal-containing bleach catalysts, bleach activators, and mixtures thereof. Bleach catalysts suitable for use include, but are not limited to: the manganese triazacyclononane and related complexes (see U.S. Pat. Nos. 4,246,612, 5,227,084); Co, Cu, Mn and Fe bispyridylamine and related complexes (see U.S. Pat. No. 5,114,611); and pentamine acetate cobalt (III) and related complexes (see U.S. Pat. No. 4,810,410) at levels from 0% to about 10.0%, by weight; and alternatively, from about 0.0001% to about 1.0%.

Typical bleach activators suitable for use include, but are not limited to: peroxyacid bleach precursors, precursors of perbenzoic acid and substituted perbenzoic acid; cationic peroxyacid precursors; peracetic acid precursors such as TAED, sodium acetoxybenzene sulfonate and pentaacetylglucose; pemonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP Pat. No. 0170386); and benzoxazin peroxyacid precursors (EP Pat. No. 0332294 and EP Pat. No. 0482807) at levels from 0% to about 10.0%, by weight; or from 0.1% to 1.0%.

Other bleach activators include to substituted benzoyl caprolactam bleach activators and their use in bleaching systems and detergents. The substituted benzoyl caprolactams have the formula:

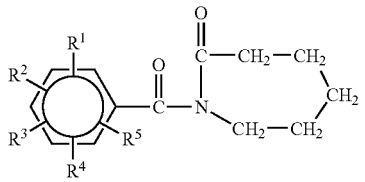

wherein $R^1$, $R^2$, $R^3$, $R^4$, and $R^5$ contain from 1 to 12 carbon atoms, or from 1 to 6 atoms and are members selected from the group consisting of H, halogen, alkyl, alkoxy, alkoxyaryl, alkaryl, alkaryloxy, and members having the structure:

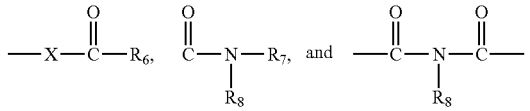

wherein $R_6$ is selected from the group consisting of H, alkyl, alkaryl, alkoxy, alkoxyaryl, alkaryloxy, and aminoalkyl; X is O, NH, or $NR_7$, wherein $R_7$ is H or a $C_1$-$C_4$ alkyl group; and $R_8$ is an alkyl, cycloalkyl, or aryl group containing from 3 to 11 carbon atoms; provided that at least one R substituent is not H. The $R^1$, $R^2$, $R^3$, and $R^4$ are H and $R^5$ may be selected from the group consisting of methyl, methoxy, ethyl, ethoxy, propyl, propoxy, isopropyl, isopropoxy, butyl, tert-butyl, butoxy, tert-butoxy, pentyl, pentoxy, hexyl, hexoxy, Cl, and $NO_3$. Alternatively, $R^1$, $R^2$, $R^3$ are H, and $R^4$ and $R^5$ may be selected from the group consisting of methyl, methoxy, and Cl.

Dispersant Polymer

Any suitable dispersant polymer in any suitable amount may be used. Unsaturated monomeric acids that can be polymerized to form suitable dispersant polymers (e.g. homopolymers, copolymers, or terpolymers) include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. may be suitable provided that such segments do not constitute more than about 50% by weight of the dispersant polymer. Suitable dispersant polymers include, but are not limited to those disclosed in U.S. Pat. Nos. 3,308,067; 3,308,067; and 4,379,080.

Substantially non-neutralized forms of the polymer may also be used in the TTW ADW detergent compositions. The molecular weight of the polymer can vary over a wide range, for instance from about 1000 to about 500,000, alternatively from about 1000 to about 250,000. Copolymers of acrylamide and acrylate having a molecular weight of from about 3,000 to about 100,000, or from about 4,000 to about 20,000, and an acrylamide content of less than about 50%, and alternatively, less than about 20%, by weight of the dispersant polymer can also be used. The dispersant polymer may have a molecular weight of from about 4,000 to about 20,000 and an acrylamide content of from about 0% to about 15%, by weight of the polymer. Suitable modified polyacrylate copolymers include, but are not limited to the low molecular weight copolymers of unsaturated aliphatic carboxylic acids disclosed in U.S. Pat. Nos. 4,530,766, and 5,084,535; and European Patent No. 0,066,915.

Other suitable dispersant polymers include polyethylene glycols and polypropylene glycols having a molecular weight of from about 950 to about 30,000, which can be obtained from the Dow Chemical Company of Midland, Mich. Such compounds for example, having a melting point within the range of from about 30° C. to about 100° C. can be obtained at molecular weights of 1450, 3400, 4500, 6000, 7400, 9500, and 20,000. Such compounds are formed by the polymerization of ethylene glycol or propylene glycol with the requisite number of moles of ethylene or propylene oxide to provide the desired molecular weight and melting point of the respective and polypropylene glycol. The polyethylene, polypropylene and mixed glycols are referred to using the formula:

$$\underset{\text{OH}}{\text{HO}}(CH_2CH_2O)_m(CH_2CH(CH_3)O)_n(CH(CH_3)CH_2O)$$

wherein m, n, and o are integers satisfying the molecular weight and temperature requirements given above.

Suitable dispersant polymers also include the polyaspartate, carboxylated polysaccharides, particularly starches, celluloses and alginates, described in U.S. Pat. No. 3,723,322; the dextrin esters of polycarboxylic acids disclosed in U.S. Pat. No. 3,929,107; the hydroxyalkyl starch ethers, starch esters, oxidized starches, dextrins and starch hydrolysates described in U.S. Pat. No. 3,803,285; the carboxylated starches described in U.S. Pat. No. 3,629,121; and the dextrin starches described in U.S. Pat. No. 4,141,841. Suitable cellulose dispersant polymers, described above, include, but are not limited to: cellulose sulfate esters (for example, cellulose acetate sulfate, cellulose sulfate, hydroxyethyl cellulose sulfate, methylcellulose sulfate, hydroxypropylcellulose sulfate, and mixtures thereof), sodium cellulose sulfate, carboxymethyl cellulose, and mixtures thereof.

In certain embodiments, a dispersant polymer may be present in an amount in the range from about 0.01% to about 25%, or from about 0.1% to about 20%, and alternatively, from about 0.1% to about 7% by weight of the composition.

Carrier Medium

Any suitable carrier medium in any suitable amount in any suitable form may be used. Suitable carrier mediums include both liquids and solids. A solid carrier medium may be used in dry powders, granules, tablets, encapsulated products, and combinations thereof. Suitable carrier medium include, but are not limited to carrier mediums that are non-active solids at ambient temperature. For example, any suitable organic polymer, such as polyethylene glycol (PEG), may be used. In certain embodiments, the solid carrier medium may be present in an amount in the range from about 0.01% to about 20%, or from about 0.01% to about 10%, and alternatively, from about 0.01% to about 5% by weight of the composition.

Suitable liquid carrier mediums include, but are not limited to: water (distilled, deionized, or tap water), solvents, and mixtures thereof. The liquid carrier medium may be present in an amount in the range from about 1% to about 90%, or from about 20% to about 80%, and alternatively, from about 30% to about 70% by weight of the aqueous composition. The liquid carrier medium, however, may also contain other materials which are liquid, or which dissolve in the liquid carrier medium at room temperature, and which may also serve some other function besides that of a carrier. These materials include, but are not limited to: dispersants, hydrotropes, and mixtures thereof.

The desired composition can be provided in a "concentrated" system. For example, a concentrated liquid composition may contain a lower amount of a suitable carrier medium, compared to conventional liquid compositions. Suitable carrier medium content of the concentrated system may be present in an amount from about 30% to about 99.99% by weight of the concentrated composition. The dispersant content of the concentrated system may be present in an amount from about 0.001% to about 10% by weight of the concentrated composition.

Binder

Any suitable binder in any suitable amount or form may be used. For example, the binding agent of a solid (e.g. granule, powder, tablet) composition holds the dry components together in a single mass. The binding agent may comprise any material which is relatively high melting and which will maintain product integrity. Suitable binders include, but are not limited to, materials such as nonionic surfactants, glycols (such as polyethylene glycol), anionic surfactants, film forming polymers, fatty acids, and mixtures thereof, wherein the binder does not melt below 40° C., as disclosed in U.S. Pat. No. 4,486,327, Murphy et al, issued Dec. 4, 1984. In certain embodiments, certain binders include alkali metal phosphates, fatty amides, and combinations thereof.

Suitable binders, for example, may be optionally incorporated in either composition at a level of from about 0.05% to about 98%, or from about 0.05% to 70%, or from about 0.05% to 50%, or from about 0.05% to 30%, or from about 0.05% to 10%, and alternatively from 0.1% to 5% by weight of the total composition. Filler materials can also be present in either composition. These may include sucrose, sucrose esters, alkali metal chlorides or sulfates, in amounts from 0.001% to 60%, and alternatively from 5% to 30% of the composition.

Hydrotrope

Any suitable hydrotrope in any suitable amount may be used. Suitable hydrotropes include, but are not limited to, sodium benzene sulfonate, sodium toluene sulfonate, sodium cumene sulfonate, and mixtures thereof.

The following references disclose a wide variety of suitable hydrotropes: U.S. Pat. Nos. 6,130,194; 5,942,485; 5,478,503; 5,478,502; 6,482,786; 6,218,345; 6,191,083; 6,162,778; 6,152,152; 5,540,865; 5,342,549; 4,966,724; 4,438,024; and U.S. Pat. No. 3,933,671.

Perfume

Any suitable perfume in any suitable amount may be used. Suitable perfumes may be classified as non-blooming, as well as, blooming perfumes. The following references disclose a wide variety of perfumes U.S. Pat. Nos. 3,983,079; 4,105,573; 4,219,436; 4,339,356; 4,515,705; 4,714,562; 4,740,327; 4,933,101; 5,061,393; 5,066,419; 5,154,842; 5,232,613; 5,500,154; 5,670,475; 6,143,707; and U.S. Pat. No. 6,194,362.

One non-limiting embodiment of the method is directed to contacting a glassware surface with a rinse aid composition comprising a perfume in an amount from about 0.01% to about 5%, alternatively from about 0.1% to about 3%, and alternatively from about 0.1% to about 2% by weight of the composition.

Adjunct Ingredients

Any suitable adjunct ingredient in any suitable amount or form may be used. Suitable adjunct ingredients may be used in the through-the-wash detergent composition and/or the rinse aid composition. Suitable adjunct ingredients include, but are not limited to: other cleaning agents (e.g. surfactants, cosurfactants), chelating agents, sequestrants, alkalinity sources, water softening agents, secondary solubility modifiers, thickeners, soil release polymers, antibacterial actives, detergent fillers, abrasives, anti-redeposition agents, threshold agents or systems, aesthetic enhancing agents (i.e., dyes, colorants, etc.), oils, solvents, and mixtures thereof.

pH

The TTW ADW detergent composition may be formulated within any suitable pH range. Suitable pH ranges may fall anywhere within the range of from about 6.5 to about 14. For example, certain embodiments of the method use an aqueous TTW ADW detergent composition having a pH of greater than or equal to about 6.5, or greater than or equal to about 7, or greater than or equal to about 9, and alternatively, greater than or equal to about 10.0. For determining pH values of solid TTW ADW detergent compositons, the pH is measured at a 10% concentration in an aqueous solution.

The rinse aid composition may be formulated within any suitable acidic pH range. The pH is measured at a 10% concentration in an aqueous solution for any form of the rinse aid composition. Suitable pHs range from about 1 to less than about 5, or from about 1 to about 4, and alternatively from about 1 to about 3. A lower pH range will tend to reduce incompatibility and negative interaction of the rinse aid composition with existing commercial rinse aid product residues left in the rinse aid dispenser reservoir of the automatic dishwashing appliance prior to use. One non-limiting embodiment of the method is directed to contacting a glassware surface with a rinse aid composition comprising a pH in the range of from about 1 to less than about 5 when measured at a 10% concentration in an aqueous solution.

Product Form

The compositions may be provided in any suitable product form. Suitable product forms, include, but not limited to: solids, granules, powders, liquids, gels, pastes, semi-solids, and combinations thereof. The compositions may also be packaged in any suitable manner. Either composition can be dispensed from any suitable device, such as bottles (pump assisted bottles, squeeze bottles, etc.), multi-compartment bottles, capsules, multi-compartment capsules, paste dispensers, and single- and multi-compartment water-soluble pouches, and combinations thereof. The compositions may be provided in the form of a unit dose, which allows for the controlled release (for example delayed, sustained, triggered, or slow release). Any suitable unit dose form may be used. For example, compositions can be provided as both liquids and/or solids, and packaged as tablets and/or as single- and/or multi-compartment water-soluble pouches so that negative interactions with other components are reduced.

The compositions may also be delivered to any suitable solution or substrate. Suitable solutions and substrates include but are not limited to: hot and/or cold water, wash and/or rinse liquor, hard surfaces, and combinations thereof.

EXAMPLES

The following examples are provided for purposes of showing certain embodiments, and as such are not intended to be limiting in any manner.

Liquid/Gel TTW ADW Detergent Composition

| | EXAMPLES | | | | | |
|---|---|---|---|---|---|---|
| Ingredients | 1 | 2 | 3 | 4 | 5 | 6 |
| STPP/SKTP/KTPP | 17.5 | 17.5 | 17.5 | 17.5 | 22.0 | 22.0 |
| ZCLM | — | 0.05 | 0.1 | 0.5 | 0.1 | 0.2 |
| Sodium hydroxide | 1.9 | 1.9 | 1.9 | 1.9 | — | — |
| Potassium hydroxide | 3.9 | 3.9 | 3.9 | 3.9 | 5.8 | 5.8 |
| Sodium silicate | 7.0 | 7.0 | 7.0 | 7.0 | — | — |
| H2SO4 | — | — | — | — | 3.9 | 3.9 |
| Thickener | 1.0 | 1.0 | 1.0 | 1.0 | 1.2 | 1.2 |
| Sodium hypochlorite | 1.2 | 1.2 | 1.2 | 1.2 | — | — |
| Nonionic surfactant | — | — | — | — | 1.0 | 1.0 |
| Protease enzyme | — | — | — | — | 0.6 | 0.6 |
| Amylase enzyme | — | — | — | — | 0.2 | 0.2 |
| Enzyme stabilizing agents | — | — | — | — | 3.5 | 3.5 |
| Dye/perfume/speckles/water | Balance | Balance | Balance | Balance | Balance | Balance |

Granular or Powder TTW ADW Detergent Composition

| Ingredients | EXAMPLES 7 | 8 | 9 | 10 | 11 | 12 | 13 |
|---|---|---|---|---|---|---|---|
| STPP/SKTP/KTPP | 23.0 | 23.0 | 23.0 | 23.0 | 23.0 | 28.0 | — |
| Sodium citrate | — | — | — | — | — | — | 25 |
| ZCLM | — | 0.05 | 0.10 | 0.15 | 0.5 | 0.1 | 0.1 |
| Sodium carbonate | 30.0 | 30.0 | 30.0 | 30.0 | 30.0 | 30.0 | 30.0 |
| Sodium silicate | 5.5 | 5.5 | 5.5 | 5.5 | 5.5 | 5.5 | 5.5 |
| NI Ionic surfactant | 0.9 | 0.9 | 0.9 | 0.9 | 0.9 | 1.8 | 0.9 |
| Polymer dispersant | — | — | — | | | 3.3 | |
| PB1 | 4.3 | 4.3 | 4.3 | 4.3 | 4.3 | 4.3 | 4.3 |
| Catalyst (activator) | 0.004 | 0.004 | 0.004 | 0.004 | 0.004 | 0.004 | 0.004 |
| Protease enzyme | 0.6 | 0.6 | 0.6 | 0.6 | 0.6 | 1.0 | 0.25 |
| Amylase enzyme | 0.2 | 0.2 | 0.2 | 0.2 | 0.2 | 0.2 | 0.13 |
| Dye/perfume/speckles/filler/water | Balance | Balance | Balance | Balance | Balance | Balance | Balance |

Tablet/Water-soluble Pouch TTW ADW Detergent Composition

| Ingredients | EXAMPLES 14 | 15 | 16 | 17 | 18 |
|---|---|---|---|---|---|
| STPP/SKTP/KTPP | 33.0 | 33.0 | 33.0 | 33.4 | 30.7 |
| Sodium citrate | — | — | — | — | 33.6 |
| ZCLM | — | 0.1 | 0.1 | 0.1 | 0.1 |
| Sodium carbonate | 19.0 | 19.0 | 28.0 | 26.0 | — |
| Sodium silicate | 7.8 | 7.8 | 4.2 | 4.3 | — |
| NI Ionic surfactant | 3.2 | 3.2 | 6.5 | 2.3 | 0.5 |
| Polymer dispersant | — | — | 4.3 | — | — |
| NaDCC/sodium hypochloride | | | | 1.1 | — |
| PB1 | 12.8 | 12.8 | 9.3 | — | — |
| Catalyst (activator) | 0.013 | 0.013 | 1.4 | — | — |
| Protease enzyme | 2.2 | 2.2 | 0.3 | — | 1.3 |
| Amylase enzyme | 1.7 | 1.7 | 0.9 | — | 0.2 |
| Dye/perfume/speckles/filler/water | Balance | Balance | Balance | Balance | Balance |

Liquid/Gel Rinse Aid Compositions

| Ingredients | EXAMPLES 19 | 20 |
|---|---|---|
| Nonionic surfactant | 35.0 | 35.0 |
| ZnCl2 | 4.0 | — |
| Zn(NO3)2* | — | 5.6 |
| Acid | 1.2 | 1.56 |
| Polymer dispersant | — | 4.0 |
| Perfume | 0.12 | 0.12 |
| Water/hydrotrope system | Balance | Balance |
| 10% pH | 2.6 | 2.6 |

*Formed in situ by reacting ZnO and nitric acid.

Test Results

Tests 1-3 are run under the same conditions using the same or similar substrates (e.g. glasses, glass slides, and/or plates) unless otherwise noted. In each test, the substrate is washed for 50 to 100 cycles in a General Electric Model GE2000 automatic dishwasher under the following washing conditions: 0 gpg water—130° F., regular wash cycle, with the heated dry cycle turned on. On the top rack of the GE 2000, the following substrates are placed: four (4) Libbey 53 non-heat treated 10 oz. Collins glasses; three (3) Libbey 8564SR Bristol Valley 8½ oz. White Wine Glasses; three (3) Libbey 139 13 oz. English Hi-Ball Glasses; three (3) Luminarc Metro 16 oz. Coolers or 12 oz. Beverage glasses (use one size only per test); one (1) Longchamp Cristal d'Arques 5¾ oz. wine glass; and one (1) Anchor Hocking Pooh (CZ84730B) 8 oz. juice glass (when there are 1 or more designs per box—use only one design per test). On the bottom rack of the GE 2000, the following substrates are placed: two (2) Libbey Sunray No. 15532 dinner plates 9¼ in.; and two (2) Gibson black stoneware dinner plates #3568DP (optional—if not used replace with 2 ballast dinner plates).

All the glasses and/or plates are visually graded for iridescence after washing and drying using a 1-5 grading scale (outlined below). All the glasses and/or plates are also visually graded for evidence of etching using the same 1-5 grading scale used in the iridescence test. The values of grading scale are as follows: "1" indicates very severe damage to the substrate; "2" indicates severe damage to the substrate; "3" indicates some damage to the substrate; "4" indicates very slight damage to the substrate; and "5" indicates no damage to the substrate.

Test 1

Various forms (i.e. liquid-gel, powder or granular, tablet or water soluble pouch) of various detergent compositions, containing an effective amount of a ZCLM, are used and compared to the same form of these detergent compositions without a ZCLM. The results of these tests are presented in Tables I-VI. The test results show significant glassware corrosion benefit protection is provided by the presence of an effective amount of ZCLM in TTW ADW detergent compositions.-

Iridescence Test Results—Tables I-III represent a comparison of substrate iridescence.

TABLE I

Iridescence of glass substrates washed 100 cycles with Liquid Gel products:

| Substrate | Liquid Gel (Ex. 1) without ZCLM | Liquid Gel (Ex. 3) with 0.1% ZCLM (e.g. ZCH) |
|---|---|---|
| Libbey 53 (avg. of 4 glasses) | 1 | 5 |
| B. Valley wine glass | 1 | 5 |
| Luminarc Metro (avg. of 3 glasses) | 1 | 5 |
| LC Wine glass | 1 | 5 |
| Sunray plate (avg. of 2 plates) | 1 | 5 |

TABLE II

Iridescence of glass substrates washed 50 cycles with powder products:

| Substrate | Powder (Ex. 7) without ZCLM | Powder (Ex. 9) with 0.1% ZCLM (e.g. ZCH) |
|---|---|---|
| English Hi-Ball (avg. of 3 glasses) | 4 | 4 |
| B. Valley Wine glass | 5 | 5 |
| Luminarc Metro (avg. of 3 glasses) | 4 | 5 |
| Sunray plate (avg. of 2 plates) | 4 | 5 |

TABLE III

Iridescence of glass substrates washed 50 cycles with Liquid Gel products:

| Substrate | Liquid gel (Ex. 1) without ZCLM | Liquid gel (Ex. 3) with 0.1% ZCLM (e.g. zinc hydroxy sulfate) |
|---|---|---|
| English Hi-Ball (avg. of 3 glasses) | 3 | 5 |
| Luminarc Metro (avg. of 3 glasses) | 3 | 5 |
| Sunray plate (avg. of 2 plates) | 3 | 5 |

Etching Test Results—Tables IV-V represent a comparison of etching grades.

TABLE IV

Etching of glass substrate washed 50 cycles with liquid gel:

| Substrate | Liquid Gel (Ex. 1) without ZCLM | Liquid gel (Ex. 3) with 0.1% ZCLM (e.g. ZCH) |
|---|---|---|
| Libby #53 (avg. of 4 glasses) | 2.9 | 4.3 |
| English Hi-Ball (avg. of 3 glasses) | 2.3 | 3.0 |
| B V Wine (avg. of 3 glasses) | 4.0 | 5.0 |
| Luminarc Metro (avg. of 3 glasses) | 2.0 | 3.3 |
| Sunray plate (avg. of 2 plates) | 2.8 | 4.0 |

TABLE V

Etching of glass substrate washed 50 cycles with powder products:

| Substrate | Powder (Ex. 7) without ZCLM | Powder (Ex. 9) with 0.1% ZCLM (e.g. ZCH) |
|---|---|---|
| Libby #53 (avg. of 4 glasses) | 2.3 | 3.5 |
| English Hi-Ball (avg. of 3 glasses) | 2.5 | 3.5 |
| B. Valley Wine glass | 4.3 | 4.8 |
| Luminarc Metro (avg. of 3 glasses) | 2.3 | 3.8 |

TABLE VI

Etching of glass substrate washed 50 cycles with liquid gel:

| Substrate | Liquid Gel (Ex. 1) without ZCLM | Liquid gel (Ex. 3) with 0.1% ZCLM (e.g. zinc hydroxy sulfate) |
|---|---|---|
| English Hi-Ball (avg. of 3 glasses) | 2 | 3.3 |
| Luminarc Metro (avg. of 3 glasses) | 2.3 | 3.7 |

It is observed that even a small amount of ZCLM (e.g. 0.1% ZCH and/or 0.1% zinc hydroxy sulfate) is sufficient to provide substantial anti-etching benefits to a treated glassware surface. The addition of about 0.1% of a ZCLM (such as ZCH or zinc hydroxy sulfate) in TTW ADW detergent compositions provides about 6-7 ppm of a ZCLM (as active zinc or $Zn^{2}$+ ions) in the wash liquor.

Test 2

The following 50 cycle test results show improved performance on glasscare using a ZCH powder versus a dispersed ZCLM composite particle (comprising PEG 8000 and ZCH) admixed to the TTW ADW detergent composition during the process of manufacture. The test results are summarized in Table VII.

TABLE VII

Dispersion Correlation - Etching of glass after 50 cycles with Powder

| Substrate | Powder (Ex. 9) with 0.1% ZCLM (e.g. ZCH) | Powder (Ex. 9) with 0.1% Active ZCLM (e.g. ZCH) in ZCLM Composite Particle* |
|---|---|---|
| English Hi-Ball (avg. 3 glasses) | 3.5 | 5.0 |
| Luminarc Metro (avg. 3 glasses) | 3.8 | 5.0 |

*A ZCLM composite particle in the amount of 0.28% by weight of the composition was used.

The ZCLM composite particle contains 35.1% ZCH, 3.5% blue dye solution, 1.4% bleach catalyst, and 60% PEG8000.

It is observed that significant glasscare benefit is achieved by incorporating the ZCH material into a dispersant polymer and/or carrier medium.

Test 3

A comparison is made between the 50 cycle test of Test 2 versus an extended, multi-variant test is performed combining multi-cycling and immersion techniques using different particle sizes. Test conditions for the test are as follows: a GE2000 machine is used with the main wash cycle manually disabled and extended to 23 hrs continuous washing followed by the regular rinse and drying cycles. Wash time for the first washing period is about 24 hrs. In the second washing period, this process is immediately repeated once on the same set of glasses after the addition of a new charge of detergent composition and wash water. Total wash time for both washing periods is about 48 hrs. Soft water (0-1 gpg) is used. An external heating element is built into the machine with a temperature controller to maintain the wash temperature at 150° F. throughout the continuous main wash cycle (immersion). At the end of the second 24 hr washing period, the glasses are dried, graded in a light box and photographed. The test results are summarized in Table VIII.

TABLE VIII

| | Particle Size Correlation - Etching of glass after 50 cycles with Powder | | | |
|---|---|---|---|---|
| | Powder (Ex. 9) with 0.1% ZCLM (e.g. ZCH) with ZCLM mean particle size of about 5-6 microns | | Powder (Ex. 9) with milled 0.1% ZCLM (e.g. ZCH) with ZCLM mean particle size of about 700 nm | |
| Substrate | 50 Cycles | 48 Hour | 50 Cycles | 48 Hour |
| English Hi-Ball (avg. 3 glasses) | 3.5 | 4.4 | 5.0 | 5.0 |
| Luminarc Metro (avg. 3 glasses) | 3.8 | 4.5 | 5.0 | 5.0 |

It is observed that significant glasscare benefit is achieved using smaller ZCLM particle sizes versus ZCLM larger particle sizes.

Test 4

Test 4 is an indirect measure of ZCLM particle crystallinity. The FWHM (full width half maximum) of reflections of an x-ray diffraction (XRD) pattern is a measure of crystalline imperfections and is a combination of instrumental and physical factors. With instruments of similar resolution, one can relate crystal imperfections or crystalline integrity to the FWHM of the peaks that are sensitive to the paracrystalline property. Following that approach, crystalline distortions/perfection are assigned to various ZCLM samples.

Three peaks (200, ~13° 2θ, 6.9Å; 111, ~22° 2θ, 4.0Å; 510, 36° 2θ, 2.5Å) are found to be sensitive to lattice distortion, the 200 reflection is selected for the analysis. The peaks are individually profile-fitted using normal Pearson VII and Pseudo-Voigt algorithms in Jade 6.1 software by MDI. Each peak is profile fitted 10 times with changes in background definition and algorithm to obtain average FWHM with standard deviations. The test results are summarized in Table IX.

TABLE IX

| | Crystallinity | | |
|---|---|---|---|
| | 200 Peak Reflection | | Relative Zinc |
| Sample | FWHM | Std. Dev. | Lability (%) |
| Brüggemann Zinc Carbonate | 0.8625 | 0.0056 | 56.9 |
| Elementis Zinc Carbonate | 0.7054 | 0.0024 | 51.6 |
| Cater Zinc Carbonate #1 | 0.4982 | 0.0023 | 42.3 |

The crystallinity appears to be related to the FWHM of its source. Not wishing to be bound by theory, it is postulated that a lower crystallinity may aid in maximizing zinc lability.

With reference to the polymers described herein, the term weight-average molecular weight is the weight-average molecular weight as determined using gel permeation chromatography according to the protocol found in Colloids and Surfaces A. Physico Chemical & Engineering Aspects, Vol. 162, 2000, pg. 107-121. The units are Daltons.

The disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

It should be understood that every maximum numerical limitation given throughout this specification would include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein. All molecular weights are calculated using the numerical average method.

While particular embodiments of the subject invention have been described, it will be clear to those skilled in the art that various changes and modifications of the subject invention can be made without departing from the spirit and scope of the invention. It should be understood that the invention is not to be considered limited to the embodiments and examples that are described in the specification.

What is claimed is:

1. A domestic, institutional, industrial, and/or commercial complete-cycle method of treating glassware surfaces in automatic dishwashing comprising the steps of:

a) providing a through-the-wash detergent composition comprising an effective amount of an insoluble, zinc-labile particulate zinc-containing material wherein said zinc-labile particulate zinc-containing material layered is selected from the group consisting of copper zinc carbonate hydroxide, zinc carbonate hydroxide having the formula: $3Zn(OH)_2 \cdot 2ZnCO_3$ or $Zn_5(OH)_6(CO3)_2$, zinc hydroxide chloride zinc hydroxide nitrate, zinc hydroxide sulfate, and mixtures thereof;

b) providing a rinse aid composition comprising an effective amount of at least one water-soluble metal salt and an acid;

c) contacting said glassware surface with said through-the-wash detergent composition; and d) contacting said glassware surface with said rinse aid composition in the rinse cycle; wherein said rinse aid composition has a pH of less than about 5 when measured at a 10% concentration in an aqueous solution.

2. A complete-cycle method according to claim 1 wherein said through-the-wash detergent composition further comprises:

i) therefor a detergent active;

ii) therefor optionally one or more of the following: a dispersant polymer, a carrier material, and mixtures thereof.

3. A complete-cycle method according to claim 2 wherein said particulate zinc-containing material has an average particle size range of from about 10 nm to about 100 microns and a particle size distribution within the range from about 1 nm to about 150 microns;

iii) therefor said detergent composition comprises a composite particle, flake, prill and/or extrudate comprising particulate zinc-containing material and one or more of the following: an additional detergent active or adjunct ingredient;

iiii) therefor during said contacting step (c), said detergent composition delivers from about 0.0001 ppm to about 100 ppm of said particulate zinc-containing material to the wash liquor.

4. A complete-cycle method according to claim 1, wherein said at least one water-soluble metal salt comprises a metal selected from the group consisting of aluminum, zinc, magnesium, calcium, lanthanum, tin, gallium, strontium, titanium, and mixtures thereof.

5. A complete-cycle method according to claim 1, wherein said rinse aid composition comprises an acid selected from the group consisting of acetic acid, aspartic acid, benzoic acid, boric acid, bromic acid, citric acid, formic acid, gluconic acid, glutamic acid, hydrochloric acid, lactic acid, malic acid, nitric acid, sulfamic acid, sulfuric acid, tartaric acid, and mixtures thereof.

6. A complete-cycle method according to claim 2 wherein said rinse said composition further comprises a dispersant polymer, wherein said dispersant polymer is a low molecular weight polyacrylate dispersant polymer having a molecular weight of less than about 15,000 and is the non-neutralized form of the polymer comprising about 70% by weight acrylic acid and about 30% by weight methacrylic acid.

7. A complete-cycle method according to claim 5 wherein said rinse aid composition comprises from about 0.0 1% to about 70% by weight of the rinse aid composition of at least one water-soluble metal salt;

and said acid is present from about 0.01% to about 25% by weight of the rinse aid composition.

8. A complete-cycle method according to claim 2 wherein said detergent active comprises one or more actives selected from the group consisting of surfactants, bleaches, bleach activators, bleach catalysts, enzymes, enzyme stabilizing systems, dyes, perfumes, or speckles.

9. A complete-cycle method according to claim 1 wherein during said contacting step (c), said detergent composition delivers from about 0.0001 ppm to about 100 ppm of said zinc-labile particulate zinc-containing material to the wash liquor; and wherein during said contacting step (d), said rinse aid composition delivers from about 0.0001 ppm to about 100 ppm of said at least one water-soluble metal salt to the rinse liquor.

* * * * *